US007963407B2

(12) United States Patent
Donnellan

(10) Patent No.: US 7,963,407 B2
(45) Date of Patent: Jun. 21, 2011

(54) ROTATING STAND (CAROUSEL) BOTTLE AND TUBE HOLDER

(76) Inventor: Jennifer Donnellan, San Rafael, CA (US)

( * ) Notice: Subject to any disclaimer, the term of this patent is extended or adjusted under 35 U.S.C. 154(b) by 0 days.

(21) Appl. No.: 12/290,572

(22) Filed: Oct. 31, 2008

(65) Prior Publication Data

US 2009/0057249 A1 Mar. 5, 2009

Related U.S. Application Data

(63) Continuation of application No. 11/228,690, filed on Sep. 16, 2005, now abandoned.

(51) Int. Cl.
*A47F 7/00* (2006.01)

(52) U.S. Cl. ..... 211/70

(58) Field of Classification Search ..... 211/70, 211/53, 78, 163, 60.1, 77, 74, 71.01, 165, 211/131.1; 206/373, 279; D6/467; 221/82
See application file for complete search history.

(56) References Cited

U.S. PATENT DOCUMENTS

| | | | | | |
|---|---|---|---|---|---|
| 196,599 | A | * | 10/1877 | Sheldon | 211/65 |
| 307,193 | A | * | 10/1884 | Hazelton | 211/62 |
| 311,613 | A | | 2/1885 | Shelden | |
| 322,600 | A | * | 7/1885 | Hazelton | 211/62 |
| 333,900 | A | * | 1/1886 | Tatum et al. | 211/65 |
| 561,243 | A | * | 6/1896 | Temple | 211/8 |
| 663,838 | A | * | 12/1900 | White | 211/70 |
| 666,769 | A | * | 1/1901 | Medearis | 211/163 |
| 736,301 | A | * | 8/1903 | Sanford | 126/338 |
| 844,431 | A | | 2/1907 | Wehagen | |
| 2,500,115 | A | * | 3/1950 | Burlin | 211/70 |
| 2,946,456 | A | | 7/1960 | Liguori | |
| 3,319,780 | A | | 5/1967 | Russell | |
| 3,858,529 | A | * | 1/1975 | Salladay | 108/103 |
| 3,966,052 | A | | 6/1976 | Knaus | |
| 4,011,954 | A | * | 3/1977 | Galli | 211/14 |
| 4,134,525 | A | | 1/1979 | Respoli | |
| 4,773,544 | A | * | 9/1988 | McCarthy | 211/69.1 |
| 4,909,400 | A | | 3/1990 | Dubinsky | |
| 4,972,947 | A | * | 11/1990 | McCarthy | 206/214 |
| 5,047,210 | A | * | 9/1991 | Melet | 422/64 |
| 5,076,444 | A | | 12/1991 | Syms | |
| D341,276 | S | * | 11/1993 | Jones | D6/457 |
| 5,403,079 | A | * | 4/1995 | Fetisoff | 312/204 |
| 5,617,960 | A | * | 4/1997 | Bishop | 211/60.1 |
| 5,641,080 | A | | 6/1997 | Humphrey et al. | |
| 5,676,261 | A | | 10/1997 | Baughman et al. | |
| 5,707,861 | A | * | 1/1998 | Sherman et al. | 435/306.1 |
| 6,000,540 | A | | 12/1999 | Larson | |
| 6,908,000 | B2 | | 6/2005 | Craft et al. | |
| 2007/0062892 | A1 | * | 3/2007 | Donnellan | 211/74 |

* cited by examiner

*Primary Examiner* — Sarah Purol
(74) *Attorney, Agent, or Firm* — Thomas W. Cook

(57) ABSTRACT

A holder for displaying and conveniently using consumables is disclosed, in which a two or more disks having corresponding, but differently sized, holes, arranged in rows, are ganged into a pair of disks, thereby allowing users to place bottles and tubes containing consumables into such holes for easy storage and access. The pair of disks is provided with rotational means, additional pairs of disks may be added in a modular fashion to increase storage capacity, and the rows of holes may be non-radially arranged, or even spirally arranged, to increase view and access to bottles and tubes.

4 Claims, 4 Drawing Sheets

ROTATING STAND (CAROUSEL) BOTTLE AND TUBE HOLDER

CROSS REFERENCE TO RELATED APPLICATIONS

This application is a continuation of application Ser. No. 11/228,690, filed Sep. 16, 2005 abandoned from which applicant claims priority.

TECHNICAL FIELD OF THE INVENTION

The present invention relates to a holder for displaying and conveniently using consumables. More specifically, the present invention is rotating stand (referred to generally herein as the "Carousel"), which apparatus holds and displays consumables for easy storage and access. The carousel allows a technician to easily select the correct consumable from among many similar consumables differing in one or more characteristics.

One very specific example of using the Carousel is the convenient storage of tubes and bottles of various shades of hair colors by a beautician (or beauty operator) on the carousel, the display of such hair colors on the carousel for easy viewing by the beautician and her client, the selection of a single hair color for such client among those residing on the carousel when the beautician and client choose a (or some) color for application to the client's hair, and the easy access to one or more tubes of the correct color or colors residing on the carousel while applying such color or colors to the hair of the client.

However, use of the carousel is not limited to storage and selection of hair color, as other consumables used by a beautician, such as lip stick or eye liner of various compositions or in various shades may be stored and displayed for easy selection and use, and all such beauty products may be conveniently displayed in a retail setting to provide most of the benefits found in the Carousel when a beautician is using the Carousel in a professional services setting.

Moreover, the Carousel may be used outside the beauty services industries in a retail setting wherever consumables differing in one or more characteristics may be found. Thus, the Carousel may be used to great advantage in retail display of a large number of products, whether hair color or other consumer products, as the Carousel may be placed on the top of a retail counter to store and display hair colors, lipstick, and the like, so consumers may easily view such products, and select the appropriate shade among the products displayed.

Finally, the Carousel may be used outside the beauty and cosmetics arena altogether wherever consumables differing in one or more characteristics may be found. Thus, the Carousel may be used to advantage in industrial settings, such as polishing or painting operations, where a large number of products, such as grinding compounds or paints, are employed by trained personnel in such operations, and such products must be kept in view, and easily accessed.

BACKGROUND ART OF THE INVENTION

A number of operations, from beautician's services to industrial polishing, require storage of consumables which are used in such operations. Such consumables are generally similar in overall character, but differ in one or more characteristics. Oftentimes, the operation at hand requires such consumables be used in some order, perhaps even serially, to achieve the best result. A highly polished surface within a reasonable period of time, for instance, requires use of rough grinding compounds, and then finer and finer compounds. Other times, such consumables need not be used in order, but they must be readily identifiable for easy selection, and readily accessible for easy use. When a beauty technician and her client jointly choose a hair color for application, for instance, the consumable must be visible to both, and reachable by the technician. Still other times, such consumables, as finished products, need only be displayed in a highly visible manner to a prospective purchaser, in pleasing and orderly fashion. Then a prospective purchaser wishes to buy cosmetics, or example, the available cosmetics must be attractively arrayed, accessible for sampling or selection, and easily put back in order when such prospective purchaser has finished sampling, or the product selected by the consumer must be replaced and restocked. Regardless of the use to which such consumables are put, all consumable which might benefit from the storage, display, and access benefits accruing from the present invention are generally referred to herein as "Consumables."

Frequently Consumables are of small sizes, and a large number of products must be stacked upon one another. Oftentimes, Consumables are not of shapes suitable to allow stacking. In such instances, Consumables may be placed in containers, such as rectangular boxes, to allow stacking of Consumables. Stacking, of course, has significant disadvantages, including instability in the stack and consequent disarray, insufficient view of package names or colors for convenient selection and replacement, and similar disadvantages. And oftentimes the outer containers for such consumables serve no useful purpose other than to provide an imperfect means to stack Consumables, and such containers are therefore soon discarded. On the other hand, Consumables are often found in tubes or other containers which are roughly uniform in shape and size, and that uniformity in tube shape and size is often reflected in the shape and size of caps or tops used to close the tubes. While holders of various kinds exist in prior for various containers, no apparatus appears to usefully grouped and conveniently hold tubes of consumables, by accommodating usual variations in shape and size of tubes and containers, and usual variations in shape and size of the caps and tops employed to close such tubes and containers. Without such apparatus, a user who uses a variety of Consumables is left to stack tubes and containers in the rectangular boxes in which they come, or hold the tubes in other sub-optimal ways, with all the disadvantages attendant thereto.

A number of devices have been developed to accomplish one or more of the purposes to which the present invention is directed, and some of these devices have one or more features of the present invention. In attempting to achieve useful storage, display, selection and access characteristics for consumables, others have created various storage and display apparatus. Such apparatus within the related art includes:

U.S. Pat. No. 311,613 to Shelden, which discloses a holder in the form of a disk, having an ordered arrangement of pockets for holding pencils.

U.S. Pat. No. 663,838 to White, which discloses a display stand having horizontal perforated rotatable disks for display of oil cloths.

U.S. Pat. No. 3,858,529 to Salladay, which discloses a multi-shelf "lazy susan" having circular shelves, and means for rotation thereunder.

U.S. Pat. No. 3,966,052 to Knaus, which discloses a tool holder having a pair of vertically spaced coaxial horizontal disks with holes formed therein for holding the shanks of drilling tools.

U.S. Pat. No. 4,909,400 to Dubinsky which discloses a rotating merchandising stand for display of merchandise contained in tubular containers.

U.S. Pat. No. 5,676,261 to Baughman et al., which discloses a holder designed to hold fishing rods, poles or pool cures for storage when transporting or when not in use.

In addition, various non-patented products are expressly directed to display of various products, including the display of cosmetics. Among such products are "revolving tiered lipstick displays" and "rotating tiered pen displays," such as those manufactured by Potomac Display and Manufacturing.

The inventions disclosed in these patents and appearing in these products appear to fulfill their respective objectives. However, these prior patents and products do not describe or suggest an apparatus which allows a user to handle Consumables in the useful ways made possible by the present invention. This is in part due to the ordered arrangement of holes in the disks of the present invention, in which the holes are arrayed in rows on each disk, each row having the same number of holes. Organizing the holes in the disks of the present invention in rows provides an ability to use Consumables in some order, even serially ordered, to achieve the best result where the operation at hand requires such ordered use. Forming the some of the holes in some disks of the present invention in appropriate sizes, in order to accommodate tubes or other containers which are roughly uniform in shape and size, provides an ability to put order in tubes' which are sized and shaped differently, as the holes are formed to accept tube diameter sizes and shapes over a range usually encountered for such tubes. Forming other holes in other disks of the present invention in other appropriate (smaller) sizes, in order to accommodate tube tops and other closures which are generally uniform in shape and size, provides an ability to securely hold such tubes in a confined but accessible, top pointed down position, again assuming the holes are formed to accept tube top diameter sizes and shapes over a range usually encountered for such tops. Top down positioning in the present invention provides the unique advantage of using gravity to move Consumables inside tubes to the opening of the tube while the tube is not in use, thereby allowing a user to easily express Consumables from tubes without squeezing such tubes along their entire length.

Thus, as but one example, an operator in a polishing or sharpening operation may chose grinding compounds from rough to fine based on the position of such compounds within a single row (the coarser compound generally being available in the outmost hole in each row), or the position of such compounds in order around a disk (the coarser compound generally being found in a single row, and associated with other coarse compounds in surrounding rows, or the order of compounds being identified by row numbers around a disk). In another embodiment of the present invention, a spice rack may be formed with substantially the same components.

Other features of the present invention which allow a user to handle Consumables in the useful ways not found in prior patents or products include the multiple vertical members holding the disks in position, as such multiple vertical members provide unusual stability and weight bearing strength. At the same time such vertical members may be longer or shorter, to accommodate different lengths and heights of tubes and bottles, thereby supplying an ability to vary the distance between nearby disks.

In combination with the metal composition of one preferred embodiment of the present invention, the stability and strength of the multiple vertical members allows a user to put heavier Consumables on each disk, and also to stack disks for additional storage of a larger variety of Consumables. Thus, a beautician, for instance, can choose how many disks she may wish to "gang" in a single assembly of the present invention, and at the same time choose varying distances between nearby disks. With such flexibility in positioning and capacity, a beautician might find she can store and array all available lines of hair color, or at least a full line of a preferred type or brand of hair color, in a single stack of disks. This may even allow the holding and display of oval shapes for bottles in some versions, in some versions of the present invention, or even square or rectangularly shaped tubes or bottles, with or without tops or other closures.

Yet other features of the present invention which allow a user to handle Consumables in the useful ways not found in prior patents or products include the non-radial arrangement of rows of holes in the disks. Non-radial arrangement enhances the Consumables or product display function of the present invention over prior inventions and products, as Consumables and products are easier to see when the invention filled with Consumables is viewed from the side. Viewed from such angle, the end of each row of Consumables is not obscured by the end of an adjacent row as one such row overlaps the other such row. Opening the view at the end of each row allows a clear view of a larger portion of each tube of Consumables, and a greater opening between rows for light by which to read identifying material in such larger portions of each tube. This enhanced display effect becomes more important as disks are added to a stack of disks in the present invention (as noted above, such stacking made possible only in the present invention), as viewing any single disk from above becomes difficult under such circumstances.

Yet other features of the present invention which allow a user to handle Consumables in the useful ways not found in prior patents or products include the spacing of disks in pairs, and the diameter of holes in each member of each such pair of disks. Rows of holes in the upper member of such pairs of disks match in their placement the rows of holes in the lower member of such pairs, so that each holes in one member of a pair of disks has a corresponding hole formed directly above or below it in the other disk of such pair. At the same time, however, each hole in the upper disk of a pair of disks is chosen to allow a tube to slip easily out of and back into its position within the invention, while each hole in the lower disk of a pair of disks is chosen to allow average diameter tube tops to be inserted within such holes, but at the same time not allow average diameter tubes to slip through the same hole. Consequently, tubes of Consumables may be easily positioned in a pair of disks, with the tube top residing in a lower hole of a pair of disks, and the shoulder of the tube to which such tube top is attached bearing against the top of the lower disk, and the tube body is somewhat loosely residing within the corresponding hole in the upper disk of the pair of disks. With this arrangement, tubes may be easily placed in position in the invention, easily removed from their position when a tube is to be used.

No patent or display of which the inventor is aware provides an ordered arrangement of holes in the disks of the display, multiple vertical members holding the disks in position (which members may be varied in length for attendant flexibility in positioning and capacity), a non-radial arrangement of rows of holes in the disks (for enhanced display effect), ganging of disks in pairs, wherein each hole in one member of a pair of disks has a corresponding hole formed directly above or below it in the other disk of such pair (such holes chosen to allow a tube to slip easily out of and back into its position) within the display.

DISCLOSURE OF INVENTION

Summary of the Invention

In its simplest form, the present invention is a holder or display for storing, displaying, and conveniently using Consumables. Such Consumables may include tubes or bottles of various shades of hair colors used by a beautician, or offered for sale at a retail counter. The holder or display comprises a rotating stand (referred to generally herein as the "Carousel") comprising at least two disks into which holes are formed. Into the holes of the disks, consumables are placed for display, and for easy storage and access. The Carousel allows a technician or a purchaser to easily select the correct consumable from among many similar consumables differing in one or more characteristics, as such technician or purchaser may easily view such products, and select the appropriate shade (or other characteristic) from among the products displayed. The Carousel further allows a technician easily access and replace the correct consumable from among such consumables, as the holes formed in the disks of the invention are positioned to allow such consumables to be removed from their place within such holes, and placed or replaced within such holes without first moving other Consumables. While the invention in its simplest form as noted above produces the intended result, a number of features of the present invention provide assurance of clear view and easy access, as well as large storage capacity, whether the invention is employed in rendering beautician services, or a retail setting, or in other industrial settings.

Most preferred embodiments of the present invention comprise at least two substantially parallel and flat circular disks (the "Disks" or, when referred to in the singular, a "Disk"), connected by one or more rigid bars (each bar a "Bar" and, collectively, the "Bars") extending between the Disks, and joining them to produce a substantially rigid body. Two Disks so joined in this fashion may be generally referred to herein as a "Pair" of Disks. The Bars and Disks are preferably composed of metal, preferably machined from steel or aluminum, however other materials are possible, and a Pair of Disks joined by Bars may be formed in a unitary fashion from lighter materials such as hard injection molded a plastic.

The Bars may be positioned between Disks of a Pair at or close to their centers, as a single Bar, or preferably as three Bars of equal length placed in a roughly triangular array. In such array, the ends of each Bar fastened to the lower Disk of a Pair (the "Foot" of each Bar or, collectively, the "Feet" of the Bars) may be fastened to the upper face of the lower Disk at a place approximately half the distance between the center of the lower Disk and its outer edge. The ends of each Bar fastened to the upper Disk of a Pair (the "Head" of each Bar or, collectively, their Heads) are fastened to corresponding points on the lower face of the upper Disk of a Pair, that is, approximately the same distance and in the same direction from the center of the upper Disk as the Foot of each Bar is from the center of the lower Disk. Accordingly, in the case where the Foot of each Bar is fastened to the upper face of the lower Disk at a place approximately half the distance between the center of the lower Disk and its outer edge, the Head of each such Bar is fastened to the lower face of the upper Disk at a place again approximately half the distance be between the center of the upper Disk and its outer edge (the corresponding positions on the upper Disk), so that each Bar extends vertically between the lower and upper Disks of a Pair if the Disks are oriented horizontally. When so positioned, the Bars extending between a Pair of Disks maintain such a Pair in rigid orientation to one another, and one Disk of the Pair directly above (or below) the other Disk of the Pair when the Disks are oriented horizontally.

Of course, the Bars in a Pair of Disks may be a single Bar extending between the centers of the upper and lower Disks, or a Pair of Disks may be held in position with more than three Bars, however three Bars is preferred for maximum strength and stability while maintaining high visibility and access to the space between any Pair of Disks, and the ability to easily increase capacity in the present invention by addition one or more additional Pairs of disks (in the manner described below). Further, the three (or more) Bars of a Pair of Disks may be positioned close to the center of such Disks, or at the edge of such Disks, or anywhere between the center and the edge of such Disks to good effect, so long as each Bar is positioned approximately as far from the center of such Disks as every other Bar is from the center of such Disks.

Into each Disk in a Pair of Disks, holes are formed of a certain size, and preferred shape, and of a certain arrangement, and formed smoothly enough to avoid injuring an operator or the exterior of a tube. Such holes are formed to accept the main bodies of tubes of Consumables in the case of the upper Disk in a Pair, and to accept the tops of such tubes of Consumables in the case of the lower Disk in a Pair. Most Consumables now are packaged in such tubes, in which the tube is filled with the desired Consumable, one end of the tube is sealed, often by folding and crimping the end, but sometimes using other methods. The other end of the tube is then generally fitted with a top assembly, which narrows the end of the tube to a threaded distal end on the top assembly. To the threaded distal end, a Screw Top closure having matching threads may be affixed to close the tube and seal the Consumable within. Because the top assembly of tube closures narrows the end of the tube to the threaded distal end in such tubes, such tubes generally appear to have "Shoulders" where the top assembly is affixed to the main body of the tube. The present invention depends on the Shoulders of such tubes having Shoulders to bear the weight of such tubes when they sit in position in the lower Disk of a Pair of Disks. However, the present invention also allows tubes which do not have Shoulders to simply rest over the holes in the lower Disk of a Pair of Disks, so long as such holes are smaller than the diameter of such tubes. This situation is common in tubes where, for instance, the caps used to close the tubes are the same size and width as the main body of the tube.

Into the lower Disk of a Pair of Disks holes are formed of a certain size, and preferred shape, and of a certain arrangement, to accept the tops of tubes of Consumables. As to the size and shape of such holes, the holes generally function best when they are substantially circular in form, and uniform in size. Such shape reduces the size necessary to allow insertion of the Screw Top closures of most tubes of Consumables, and hold the Screw Tops loosely, but securely, and with minimum movement of such Screw Top closures within the diameter of the hole. Uniformity in size allows Screw Top closures for tubes of Consumables having generally similar properties, and so generally contained within tubes of uniform cross-sectional size, to be held in approximately the same position in the holes of the lower Disk of a Pair of Disks.

As to the absolute size of each hole in the bottom Disk of a Pair of Disks, the Screw Top closures for tubes of Consumables are often not standardized even within a single industry. However, the size of the holes may be chosen to accept the Screw Tops for most Consumables within an industry, while preventing the remainder of such tubes from traveling into such holes, as the Shoulders of the tubes of Consumables are broad enough to rest on the lower Disk, and too broad to fall through the holes in the lower Disk. Accordingly, when a tube or tubes of Consumables are placed in the present invention with their top, or closure, end down (i.e., with Screw Tops pointing down when the Screw Tops are screwed onto the tube closure assembly), the Screw Tops of such tubes may extend into the holes of the lower Disk, and the Shoulders of the tubes may rest on the upper surface of the lower Disk.

Into the upper Disk of a Pair of Disks holes are also formed of a certain size, and preferred shape, and of a certain arrangement, to accept the main body of tubes of Consumables. Again, such holes generally function best when they are substantially circular in form, and uniform in size. Such shape reduces the size necessary to allow insertion of the main body of most tubes of Consumables, and holds tubes loosely, but securely, and with minimum movement of such main body within the diameter of the hole. Uniformity in size allows tubes of Consumables having generally similar properties to be held in approximately the same position in the holes of the upper Disk of a Pair of Disks. Uniform positioning of the main body of tubes of Consumables within the holes of the upper Disk of a Pair of Disks allows a user to apply her senses in a somewhat uniform manner to observe each tube, and allows a user to use her hands in approximately the same fashion to secure a tube for use (and replace it when necessary), even when the tubes of Consumables are not precisely uniform in shape or size. Each hole in the upper Disk of a Pair of Disks is formed to allow tubes to slip easily out of and back into its position within the invention.

The holes in the upper Disk of a Pair of Disks also must be formed in the upper Disk of a Pair of Disks to match in their placement the holes in the lower Disk of such a Pair, so that each hole in one member of a Pair of Disks has a corresponding hole formed directly above or below it in the other Disk of such Pair. When so arranged while each hole in the lower Disk of a Pair of Disks allows average to large diameter Screw Tops to be inserted within such lower holes, but at the same time not allow average to small diameter tubes to slip through the same lower hole. Consequently, tubes of Consumables may be easily positioned in a Pair of Disks with their Screw Tops pointed down. In such position, the tube Screw Top resides in a lower hole of a Pair of Disks, and the Shoulder of the tube to which such tube Screw Top is attached bears against the top surface of the lower Disk. In such position, the tube main body is somewhat loosely residing within the corresponding hole in the upper Disk of the Pair of Disks. With this arrangement, tubes may be easily placed in position in the invention, easily removed from their position when a tube is to be used.

The holes in both the upper Disk and the lower Disk of a Pair of Disks are best also formed in rows. Thus, the holes in the upper Disk may be formed in rows extending from the center or central portion of the upper Disk, radially to a point at or near the outer edge of the upper Disk. The corresponding (but smaller) holes of the lower Disk may be formed in complimentary rows, again radially, so that each hole in one member of a Pair of Disks has a corresponding hole formed directly above or below it in the other Disk of such Pair. Radial arrangement of rows of holes in each Disk of a Pair allows an accounting for Consumables of a single characteristic (such as color) among the array of Consumables, as the user can see that a tube of Consumable having that characteristic is best placed with other tubes of Consumables having that characteristic. This is, in may applications, Consumables should be placed in rows for a variety of reasons, but at least for the reason that a user wishes to know how many tubes of Consumables of a like characteristic are left within an inventory of tubes.

The holes in both the upper Disk and the lower Disk of a Pair of Disks are also best formed rows which, again, are formed in rows extending from the center or central portion of such Disks, to a point at or near the outer edge of the upper Disk, but which are not formed radially. In this preferred arrangement, the rows of each Disk are angled from the central portion of each Disk outward, or even arranged spirally from the central portion of each Disk outward. Again, the corresponding (but smaller) holes of the lower Disk must be formed in complimentary rows, so that each hole in one member of a Pair of Disks has a corresponding hole formed directly above or below it in the other Disk of such Pair. Non-radial arrangement of rows of holes in each Disk of a Pair allows a user to peruse each row of Consumables from a wider angle. At the same time, non-radial arrangement of rows of holes allows formation of a greater number of holes in each row, or the placement of more or wider tubes of Consumables within a Pair of Disks, as slanting the rows from central portion to edge of Disk provides more linear distance within each row. Such additional linear distance may be used for one or more holes in each row, or such additional distance may be used to form holes further from one another, consequently widening the distance between holes so wider tubes of Consumables may be accommodated.

The rows of holes in the Disks of the present invention may extend toward the center of each Disk, but it may be appreciated that such rows cannot extend to the center of each Disk, or even close to the center of such Disks. In arranging rows, sufficient room must be provided to accommodate tubes of Consumables of finite size, so tubes of Consumables in each row may extend toward the center of the Disks only until they touch one another. This sets an absolute limit on how close each row may extend toward the center of the Disks if all rows are to have equal numbers of holes. Of course, any one row may extend to the center of the Disks, or a few holes may be formed in the central portion of the Disks without being set in rows, however tubes of Consumables placed in centrally located holes will be difficult to observe, and difficult to reach without moving other tubes first to make a way from the central portion to the edge of the Disks.

Most preferred embodiments of the present invention provide a facility to fasten multiple Pairs of Disks together (that is, to "Gang" one or more Pairs of Disks, or to produce "Ganged" Pairs of Disks) to increase the holding or storage capacity of the invention. Thus, a Pair of Disks, held rigidly in relation to one another as described above, is also held rigidly in relation to another Pair of Disks. When Pairs of Disks are Ganged in this fashion, connecting "Legs" extend between each adjoining Pair of Disks, and are either attached to the nearest Disk of such Pairs, or are attached to the Bars connecting the Disks of each Pair. And the Ganging of Pairs of Disks may be extended to a large number of Pairs, thereby increasing the holding capacity of the present invention, up to the point where the present invention becomes unstable if it is not affixed to a stable surface. If so affixed, the present invention may extend literally floor to ceiling.

Ganging of Pairs in this way is preferably done in a modular fashion, using Bars and Legs which engage each other through the nearest Disk of a Pair. That is, a lowest Pair of Disks is held rigidly together with (preferably) three Bars, the Heads of which may extend through the upper Disk of this Pair. The Heads of these Bars may formed with male threads, so that the female threads found at the Foot of (three) corresponding Legs may be screwed over the male threads of these Bars. At the other end of these Legs, their Heads are likewise threaded, and may extend through the lower Disk of the next Pair of Disks, so that the threads found in the Bars holding the next Pair of Disks rigidly together may be engaged. Upon such engagement (and tightening of Bars to Legs), the upper Pair of Disks is rigidly held in relation to the lower Pair of Disks. The arrangement of Pairs of Disks, each having Bars between the Pairs, may be extended using additional Legs between the Pairs, from two Pairs of Disks to three Pairs of Disks, to four Pairs of Disks, and so on. Of course, the gender of threads on any set of Bars and Legs may be reversed, so that male threads of a set of Legs may extend to and into the female threads on the set of Bars immediately below. Any arrangement of threaded Bars and Legs are within the scope of the present invention.

Further, Pairs of Disks may be Ganged in this fashion at different heights, resulting in greater or lesser distance between Pairs, by choosing Legs either longer or shorter. Variation in Leg length therefore allows larger or longer tubes of Consumables to be stored at one level of the present invention, by insertion of the tubes in the holes of one Pair of Disks, and smaller or shorter tubes of Consumables to be stored at another level of the present invention. Further still, adjustment in the size of holes in any one Pair of Disks, and adjustment in the distance between such holes, allows tubes of shorter or narrower average size or length to reside on a different level than tubes of longer or wider average size (generally, larger tubes are best kept with other larger tubes, and smaller tubes with other smaller tubes).

In one preferred embodiment of the present invention, the lowest Pair of Disks is fitted with rotation means, whereby the lowest Pair of Disks may be rotated as they reside on a counter top or on the floor. The most common arrangement for such rotation means includes a substantially flat base, upon which the present invention sits when in an upright position, positioned just below the lowest Disk of the lowest Pair of Disks. Between the base and the lowest Disk, and generally affixed thereto or formed therein, a pair of circular tracks or races reside or are formed, between which ball bearings are trapped. Within the races, however, the ball bearings may move circumferentially around the races. Other means, including standard means, for rotation may be used to provide a facility to rotate, so long as such means are suitable to saving space between a horizontally oriented Pair of Disks and the base, and all such means are within the scope of the present invention.

In but one application for the present invention, that of for storage, display, and access to hair color when used by a beautician, a preferred embodiment of the present invention may be dimensioned to good effect when the components of the invention are sized as follows:

1. The Disks of a Carousel may be substantially circular, and approximately 15 inches in diameter.
2. The Bars between adjacent Disks in a pair of Disks may be approximately one and three-quarter inches long, with the result that the Disks in a Pair of Disks are positioned approximately one and three-quarter inches from one another when the Disks are assembled into a Pair using such Bars.
3. The Legs between the first (lowest) Pair of Disks and the second (next higher and adjacent) Pair of Disks may be approximately six inches long, with the result that the first and second Pairs of Disks are positioned approximately six inches from one another when such Pairs are assembled one to the other. Six inch legs generally result in distances between Pairs of Disks suitable for tubes and bottles of standard size, without unduly wasting space. However, longer and shorter legs may be employed to accommodate tubes and bottles of non-standard size, either longer or shorter.
4. The Legs between the second Pair of Disks and the third (next higher than, and adjacent to, the second) Pair of Disks may be approximately four and one-half inches long, with the result that the second and third Pairs of Disks are positioned approximately four and one-half inches from one another when such Pairs are assembled one to the other.
5. The Bars and the Legs may all be round, tubular aluminum, and approximately three-quarters of one inch in diameter, as uniform diameter in Bars and Legs produces a sleek, uniform look, and wide diameter Bars and Legs provides sufficient resistance to bending that the Carousel remains light, strong and stable.
6. The Bars and Legs may all have at their Heads male thread extending through each Disk, and at their Feet female threads into which the male threads from the next lower component may be screwed (with female threaded caps, or acorn nuts at the upper ends of the uppermost Bars as they extend through the uppermost disk).
7. There may be 14 rows of holes formed in each lower Disk and each upper Disk in each Pair of Disks. Such holes may be formed three holes deep from Disk edge to Disk center, the inner most holes having centers at about seven inches from the centers of each Disk, the outer most holes having centers at about twelve and one-half inches from the centers of each Disk, and the holes between the inner and outer most holes having centers at about nine and one-half inches from the centers of each Disk.
8. The holes in each lower Disk in a Pair of Disks may be approximately five-eighths of one inch in diameter, and the holes in each upper Disk in a Pair of Disks may be approximately one and three-eighths inch in diameter.
9. The base upon which the Carousel turns may be approximately 12 inches in diameter, and approximately three-eighths inch tall, and the clearance between the base and the lowest Disk in the lowest Pair of Disks may be approximately one-half inch.

When the components of the Carousel are so arranged, a beautician may store 42 tubes of hair color in each Pair of Disks, and when Pairs are Ganged as set forth above, three levels of tubes may be stored for a total of 126 tubes. With such storage capacity, a beautician may place only one color in each row of holes in a Pair of Disks, but thereby store 42 different hair colors. As each tube is visible because each row is angled, each color stands out separately from each other color, and the angle of the rows provides easy access to tubes residing closest to the center of the Disks as well as easy access to tubes residing near the outer edge of the Disks. As the entire Carousel assembly may rotate, the beautician may easily view and reach colors which may reside on the far side of the Carousel by simply rotating the entire assembly of Disks on the base to bring the desired tubes of color into view and reach.

In another embodiment of the present invention, a spice rack may be formed with substantially the same components. In such an embodiment, the holes in both the upper Disk and the lower Disk of a Pair of Disks are, again, formed in rows extending from the center or central portion of such Disks, to a point at or near the outer edge of the upper Disk. The rows of holes are again not formed radially, but are angled from the central portion of each Disk outward, or even arranged spirally from the central portion of each Disk outward. And again, corresponding (but smaller) holes of the lower Disk may be formed in complimentary rows, so that each hole in one member of a Pair of Disks has a corresponding hole formed directly above or below it in the other Disk of such Pair. However, in a spice rack, the non-radial arrangement of rows of holes in the Disks of a Pair is more important to overall usability of the spice rack, as bottles of spices purchased retail are often quite wide, and the "offset" of holes from center to outer edge allows a user to peruse each such bottle more clearly as the bottles toward the center of the Disks are not hidden from the user by bottles near the outer edge of the Disks. At the same time, by employing a larger such offset between adjacent holes radially, a sufficient number of holes may be formed in the Disks to allow a greater usable number of bottles to be placed in each row. Again, slanting or spiraling the rows from central portion to edge of Disk provides more linear distance within each row for the placement of the wider tubes often used for Consumables such as spices.

The more important features of the invention have thus been outlined, rather broadly, so that the detailed description thereof that follows may be better understood, and in order that the present contribution to the art may be better appreciated. Additional features of specific embodiments of the invention will be described below. However, before explaining preferred embodiments of the invention in detail, it may be noted briefly that the present invention substantially departs from pre-existing apparatus and methods of the prior art, and in so doing provides the user with the highly desirable features of (1) placing tubes of Consumables to rest on their Shoulders on the upper face of the lower Disk of each Pair, thereby allowing Consumables to flow toward tube tops when stored, with the result that more Consumable may be expressed from each tube, (2) providing an ordered arrangement of holes in all Disks of the Carousel, for ease of viewing, (3) providing multiple vertical members holding the Disks in position, which members may be varied in length for attendant flexibility in positioning and capacity, (4) providing a non-radial arrangement of rows of holes in the Disks (for enhanced display effect, and enhanced access to each tube), (5) Ganging of Disks Pairs, for large tube-holding capacity (6) providing a means to rotate the entire assembly of Disks, for additional view and access of tubes not immediately in reach, and (7) providing holes in which one member of a Pair of disks has a corresponding hole formed directly above or below it in the other Disk of such Pair, such holes chosen and formed to allow each tube to slip easily out of and back into its (correct) position within the Carousel.

OBJECTS OF THE INVENTION

A principal object of the present invention is to allow Consumables from tubes to be expressed from such tubes because such Consumables flow toward tube tops when stored.

A further principal object of the present invention is to provide an ordered arrangement of holes in all Disks of the Carousel, for ease of viewing.

A further principal object of the present invention is to provide multiple vertical members holding the Disks of a Carousel in position, which members may be varied in length for attendant flexibility in positioning and capacity.

A further principal object of the present invention is to provide a non-radial arrangement of rows of holes in the Disks, to enhance the display access to each tube for a user or prospective purchaser.

A further principal object of the present invention is to provide large tube-holding capacity by Ganging of Disks Pairs.

A further principal object of the present invention is to allow a user rotate the entire assembly of Disks, for additional view and access of tubes not immediately in reach.

A further principal object of the present invention is to provide a means for holding tubes of consumables in the form of holes in which one member of a Pair of disks has a corresponding hole formed directly above or below it in the other Disk of such Pair, such holes chosen and formed to allow each tube to slip easily out of and back into its (correct) position within the rotatable Carousel.

BRIEF DESCRIPTION OF DRAWINGS

The accompanying drawings, which are incorporated in and constitute a part of this specification, illustrate one preferred embodiment of the present invention, and such drawings, together with the description set forth herein, serve to explain the principles of the invention.

FIG. 2 is a lateral view drawing of the preferred embodiment of the Carousel of the present invention shown in FIG. 2, in which the Disks of the embodiment are viewed edge on.

DETAILED DESCRIPTION OF A FIRST PREFERRED EMBODIMENT

Figure 1:
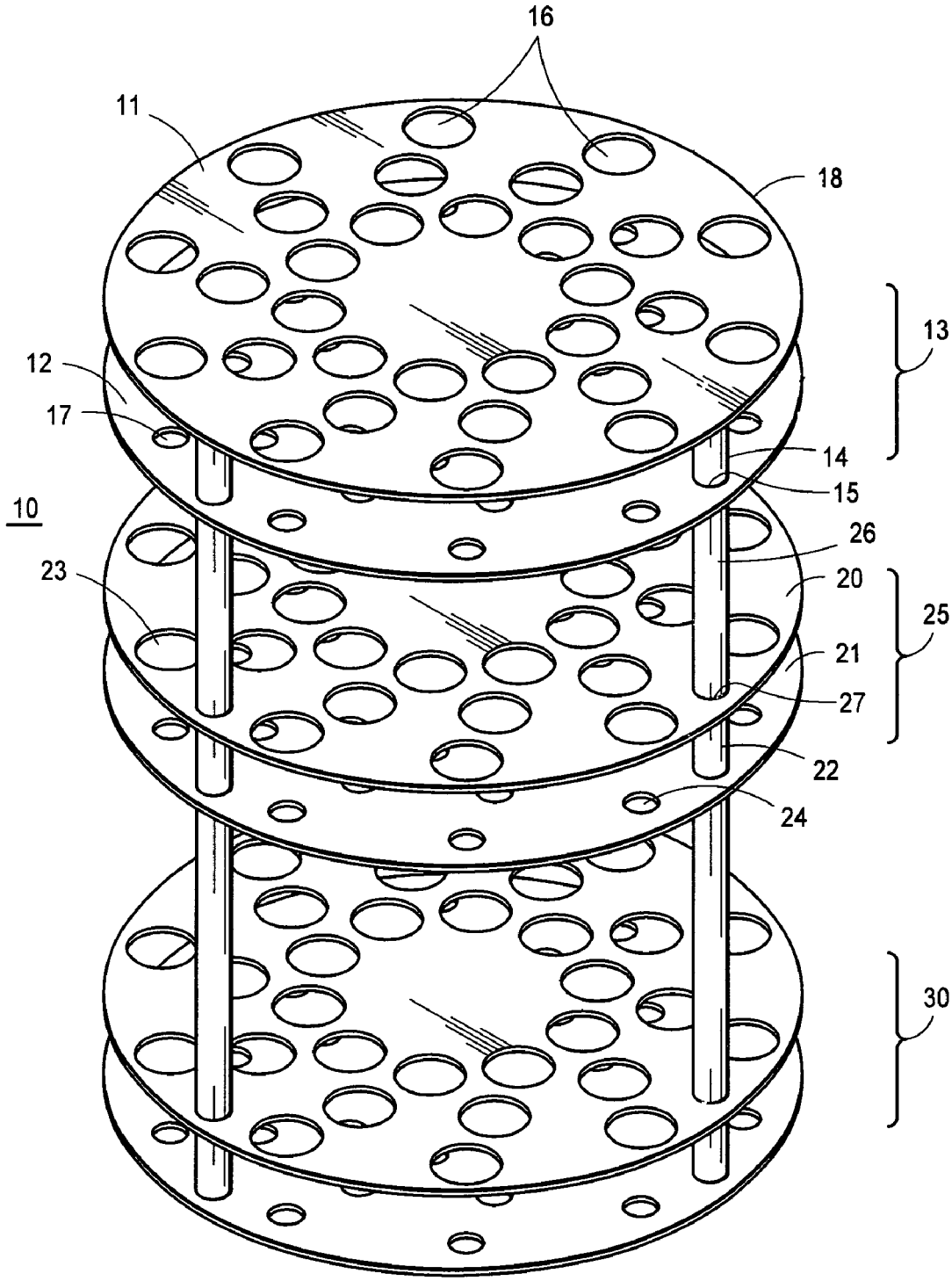
FIG. 1 is a perspective view drawing of a first preferred embodiment of the Carousel of the present invention, viewed from above the level of its topmost Disk.

Referring initially to FIG. 1, a first preferred embodiment of the Carousel of the present invention is shown in perspective view, viewed from above the level of its topmost Disk. In FIG. 1, the Carousel of the present invention 10 has a substantially circular and flat upper Disk 11 ganged with a similar substantially circular and flat lower Disk 12 in a topmost Disk tier, or Pair 13 of Disks. In one preferred embodiment, Disk 11 and Disk 12 are approximately fourteen and one-half inches in diameter, however a wide variety of Disk diameters may be used, depending on the size of the container or tube containing the Consumable at hand (not shown), so long as each Disk is approximately the same diameter in any single Carousel assembly. The Pair 13 are so ganged by utilizing three vertically oriented Bars 14 of substantially equal length. Bars 14 and Disks 11 and 12 are preferably composed of metal, preferably machined from steel or aluminum, however other materials are possible, and a Pair of Disks joined by Bars may be formed in a unitary fashion from lighter materials such as hard injection molded plastic. Bars 14 in FIG. 1 are positioned between Disks 11 and 12 in Pair 13 at or close to the edges of each of Disk 11 and 12, in a roughly triangular array. In such array, the ends of each Bar 14 is fastened to lower Disk 12 of the Pair 13 at the Foot 15 of each Bar 14. The ends of each Bar 14 is also fastened to the upper Disk 11 of Pair 13 at the Head (not shown) of each Bar 14, at points which correspond to the points of attachment at Foot 15 of each Bar 14. That is, the Head (not shown) of each Bar 14 is fastened to upper Disk 11 approximately the same distance and in the same direction from the center of the upper Disk 11 as Foot 15 of each Bar 14 is from the center of lower Disk 12. Accordingly, each Bar 14 extends vertically between lower Disk 12 and upper Disk 11 of Pair 13 when Carousel 10 is oriented horizontally and, when so positioned, Bars 14 maintain the Disks 11 and 12 of Pair 13 in rigid orientation to one another. The Bars between ganged (and so adjacent) Disks according to the present invention may be of any length, however Bars 14 shown in FIG. 1 are approximately one and three-quarter inches long, with the result that upper Disk 11 and the lower Disk 12 in Pair 13 are rigidly positioned approximately one and three-quarter inches from one another when Disks 11 and 12 are assembled into Pair 13 using Bars 14.

Continuing with FIG. 1, holes are formed into each Disk in Pair 13, the holes being of preferred size, shape, and arrangement. Beginning with the holes on upper Disk 11 of Pair 13, upper holes 16 are formed to accept the main bodies of tubes of Consumables (not shown). Accordingly, upper holes 16 may be of any size to fit such tube bodies, however for hair color Consumables, upper holes 16 in upper Disk 11 of Carousel 10 are preferrably approximately one and three-eighths inches in diameter. Lower holes 17 on lower Disk 12 of Pair 13 are formed to accept Screw Top closures (not shown) of tubes of Consumables, which Screw Top closures have threads matched to the threads of the distal end of the narrowed ends of the screw-tops of the tubes of Consumables. Accordingly, lower holes 17 may be of any size to fit such Screw Top closures, however for hair color Consumables, lower holes 17 in lower Disk 11 of Carousel 10 are preferrably approximately five-eighths inches in diameter.

Upper Holes 16 in upper Disk 11 and lower holes 17 in lower Disk 12 of Pair 13 are best formed in rows. Thus, upper holes 16 are in FIG. 1 formed in rows extending from the center or central portion of upper Disk 11, to points at or near the outer edge 18 of upper Disk 11. Corresponding (but smaller) lower holes 17 of lower Disk 12 are in FIG. 1 formed in complimentary rows, so that each upper hole 16 in upper Disk 11 of Pair 13 has a corresponding lower hole 17 formed in lower Disk 12 directly below upper hole 16 in Disk 11 of Pair 13. The rows of holes in each Disk of a Pair may be radially oriented on each such Disk, from or near the center radially outward to points near the edge of each Disk. However, holes upper Disk 11 and lower Disk 12 of Pair 13 are preferrably formed in angled rows, i.e., rows which are not formed strictly radially. In this preferred arrangement, the rows of each Disk of a Pair are angled from the central portion of each Disk outward, and in FIG. 1 this non-radial arrangement of rows of holes is apparent. In yet other preferred embodiments of the present invention, the rows of holes in each Disk of a Pair may are so angled from the central portion of each Disk outward as to create a shallow spiral arrangement of holes, and in FIG. 1 this spirally angled arrangement of rows of holes is also apparent. In all arrangements of holes in the Disks of the present invention, however, FIG. 1 shows corresponding (but smaller) lower holes 17 of lower Disk 12 must be formed in complimentary rows to the rows of upper holes 16 of upper Disk 11, so that each upper hole 16 in upper Disk 11 has a corresponding lower hole 17 formed in Disk 12 directly below each upper hole 16.

Continuing with FIG. 1, a second upper Disk 20 and second lower Disk 21 are ganged utilizing a second set of Bars 22 in the manner of Disks 11 and 12, and upper holes 23 are formed into upper Disk 20, and lower holes 24 are formed in lower Disk 21 in the resulting second Pair 25. However, while FIG. shows Bars 22 being of approximately equal length to Bars 14, Bars 22 and Bars 14 may be of different lengths, with the result that Pair 25 may accept tubes of Consumables (not shown) which are longer or shorter than those which may reside in Pair 13. And while FIG. 1 shows upper holes 23 being of approximately equal diameter to upper holes 16, and lower holes 24 being of approximately equal diameter to lower holes 17, the diameter of upper holes 23 in Disk 20 may be different from the diameter of upper holes 16 in Disk 11, and the diameter of lower holes 24 in Disk 21 may be different from the diameter of lower holes 17 in Disk 12, and holes in any row of any Disk may be of different diameter than the holes of other rows on the same Disk.

In FIG. 1 pair 25 and Pair 13 are separated from one another and held in rigid position in respect of one another utilizing three vertically oriented Legs 26 of substantially equal length. Legs 26 are also preferably composed of metal, preferably machined from steel or aluminum, however other materials are possible. Legs 26 are positioned between Pairs 25 and 13 in Carousel 10 at or close to the edges of each of Disk 20 and 12, in a roughly triangular array. In such array, the ends of each Leg 26 is fastened to lower Pair 25 at the Foot 27 of each Leg 26. The ends of each Leg 26 are also fastened to the upper Pair 13 at the Head (not shown) of each Leg 26, at points which correspond to the points of attachment at Foot 27 of each Leg 26, that is, approximately the same distance and in the same direction from the center of upper Pair 13 and lower Pair 25. Accordingly, each Leg 26 extends vertically between lower Pair 25 and upper Pair 13 when Carousel 10 is oriented horizontally and, when so positioned, Legs 26 maintain Pair 25 an Pair 13 in rigid orientation to one another. The Legs between Pair 25 and Pair 13 according to the present invention may be of any length, however Legs 26 shown in FIG. 1 are approximately seven inches long, with the result that Pair 25 and Pair 13 are rigidly positioned approximately seven inches from one another when Pair 25 is affixed to Pair 13 using Legs 26.

In FIG. 1, Bars 14 and Legs 26 are aligned virtually end to end on either side of each Disk in the Carousel 10 assembly, and are affixed to each Disk near its edge. However, other arrangements of Bars and Legs is possible, and within the scope of the present invention, as set forth herein. In FIG. 1, Pairs 13 and 25 are assembled in modular fashion, using Bars 14 and Legs 26 which engage each other through the Disks of each Pair in any way usual for such engagement. FIG. 1 does not show the details of such engagement, however such engagement is generally accomplished as male threads formed on extensions at the heads of Bars 14, extend through an adjacent Disk, to screw into corresponding threaded female recesses in the feet of Legs 26 next in line in an alignment of Bars and Legs. Similarly, male threads formed on extensions at the heads of Legs 26 extend through an adjacent Disk, to screw into corresponding threaded female recesses in the feet of Bars 14 next in line in an alignment of Bars and Legs. In this fashion, Carousel 10 may be built up in a modular fashion, as Pairs of Disks are added one to the other, beginning with Pair 30 should the user chose to add one additional Pair to Pairs 13 and 25 as in FIG. 1.

Figure 2:
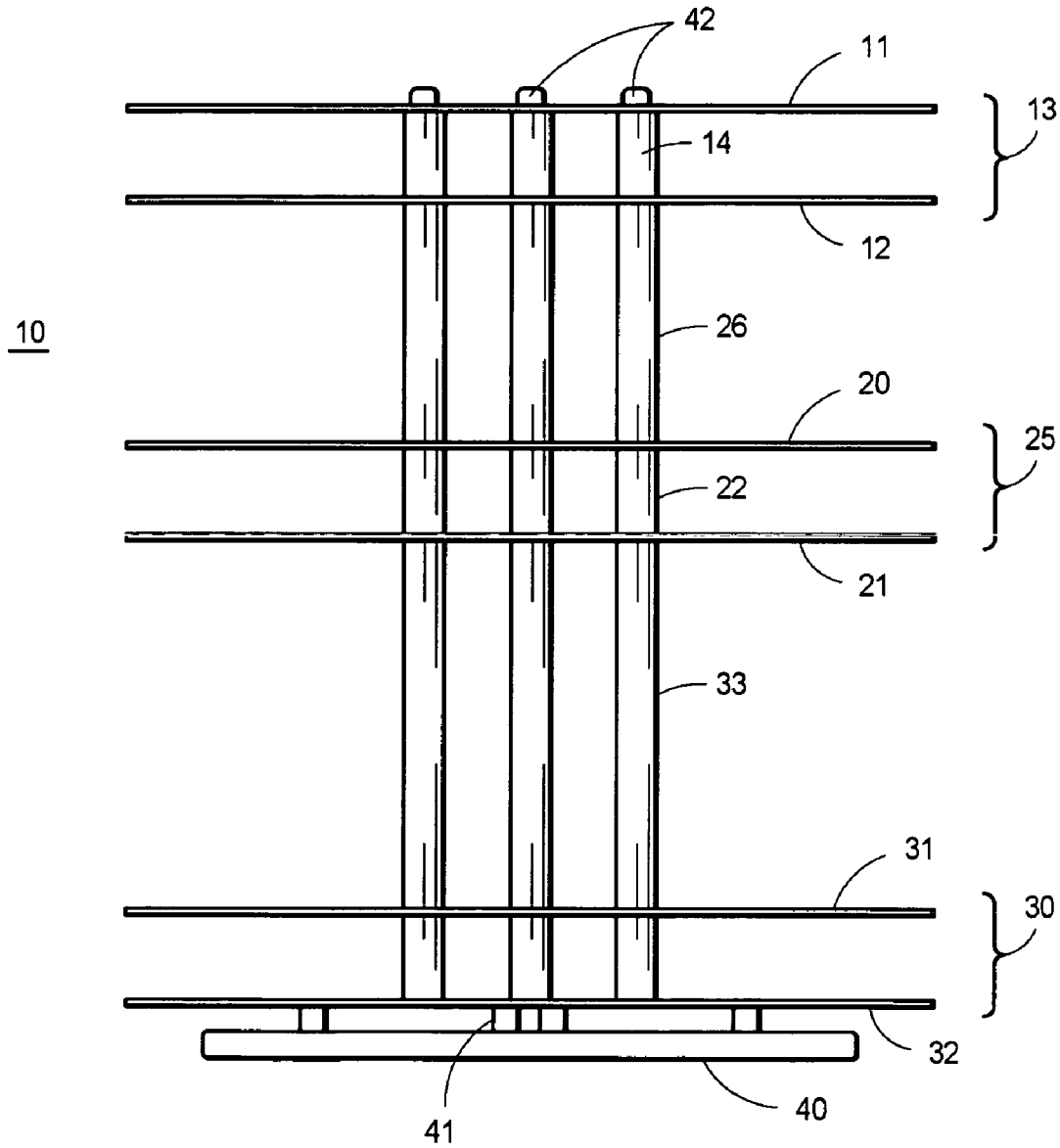

Turning now to FIG. 2, a Carousel 10 assembly of Pairs of Disks 13, 25, and 30, are shown from its side, i.e, a lateral view drawing of the preferred embodiment of Carousel 10 shown in FIG. 1, in which the Disks 11, 12, 20, 21, 31, and 32 of the embodiment are viewed edge on. FIG. 2 also shows Bars 14 and 22 which gang Pair 13 and Pair 25 respectively, and such Bars are the same one and three-quarter inches in length shown in FIG. 1. However, while Legs 33 between Pair 25 and Pair 30 are approximately seven inches long, Legs 26 are a shorter four and one-half inches in length. The user may generally vary the distance between Pairs by using Legs of different length as shown in FIG. 2, and the Bars which gang each Pair may also be varied in length as the Carousel assembly may be assembled by user in a variety of ways to accommodate the tubes of Consumable with which the user deals.

FIG. 2 also shows a base 40, approximately twelve inches in diameter and approximately three-eighths inch thick. However, base 40 may be of a wide range of diameters and thicknesses. FIG. 2 also shown a rotation means 41, which may be formed in any manner usual to "lazy susan" type rotational motion, which allows Carousel assembly 10 to rotate on base 40 when assembly is oriented vertically above base 40. FIG. 2 also shows acorn nuts 42 affixed to the threaded extensions of Bars 14 (not shown) to secure Disk 11 to the top of Carousel 10 without the use of additional Bars or Legs. Finally, it may be noted that FIG. 2 shows aligned Bars 14 and Legs 26 and 33 affixed to the Disks of Carousel 10 near the center of such Disks, rather than near the edge of such Disks as in FIG. 1. The more centered location for supporting member Bars and Legs is generally preferred, though not required, to allow better view of tubes of Consumables held within Carousel 10, and better access as a user inserts her hand between Pairs of Disks.

Figure 3:
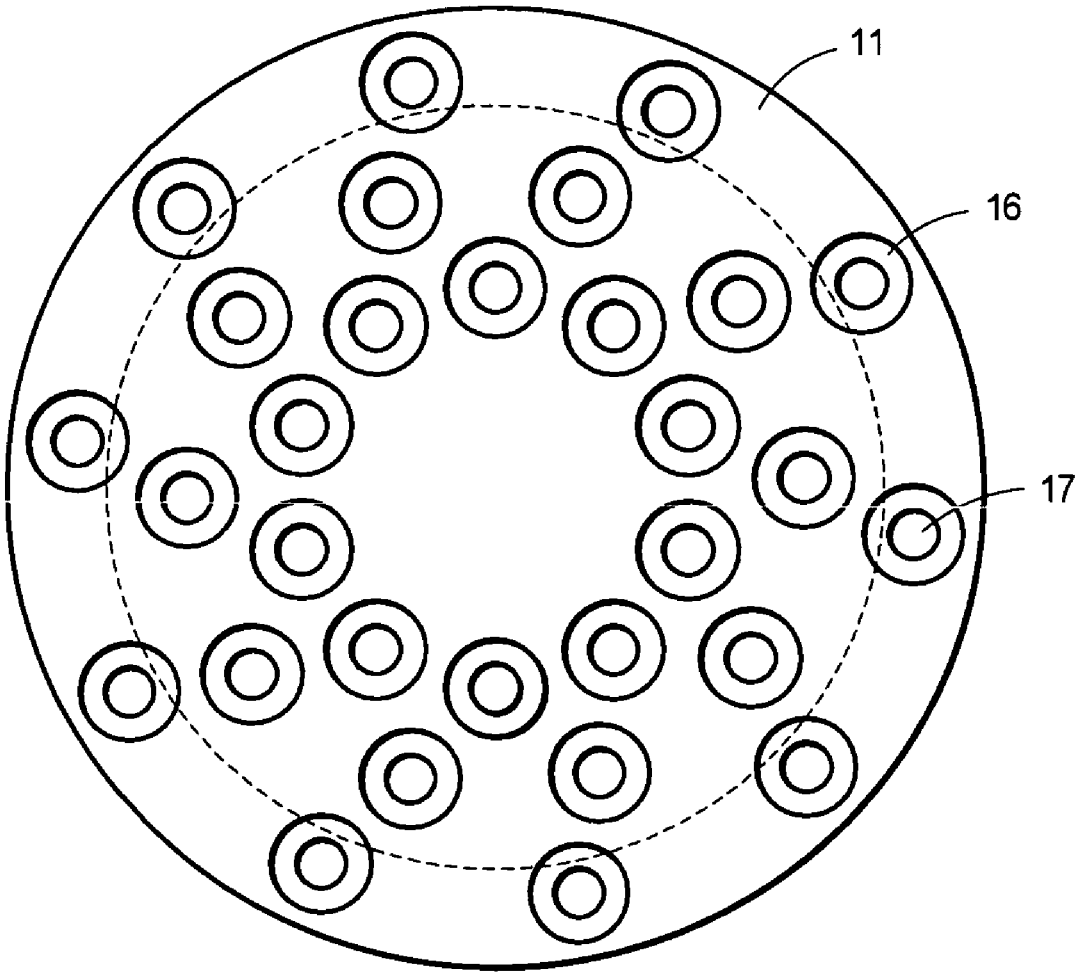
FIG. 3 is a plan view drawing of the Disks of the preferred embodiments of the Carousel of the present invention shown in FIGS. 1 and 2, viewed from the top down.

Turning now of FIG. 3, a plan view drawing of a representative Pair of Disks of the preferred embodiments of the Carousel of the present invention is shown, viewed from the top down as if such Pair were Pair 13 held in ganged position by Bars 14. From this perspective, upper holes 16 formed into upper Disk 11 of Pair 13 to accept the main bodies of tubes of Consumables (not shown) may be seen. As noted herein, holes 16 may be formed in a variety of sizes to fit tubes of a variety of sizes, however for hair color Consumables, upper holes 16 in upper Disk 11 of Carousel 10 are preferrably approximately one and three-eighths inches in diameter. Lower holes 17 on lower Disk 12 (not shown, except through upper holes 16) of Pair 13 may be seen, and are formed to accept Screw Top closures (not shown) of tubes of Consumables. As noted herein, upper holes 16 and lower holes 17 are best formed in rows, extending from near the center or central portion of upper Disk 11 and lower Disk 12 to points at or near the outer edge 18 of upper Disk 11 and lower Disk 12. In FIG. 3, upper holes 16 in upper Disk 11 and lower holes 17 in lower Disk 12 of Pair 13 are preferrably formed in angled rows, i.e., rows what which are not formed strictly radially, or even in a shallow spiral arrangement of holes (not shown). In all cases, however, and in all arrangements of holes in the Disks of the present invention, lower holes 17 of lower Disk 12 must be formed in complimentary rows to the rows of upper holes 16 of upper Disk 11, so that each upper hole 16 in upper Disk 11 has a corresponding lower hole 17 formed in Disk 12 directly below upper hole 16.

Figure 4:
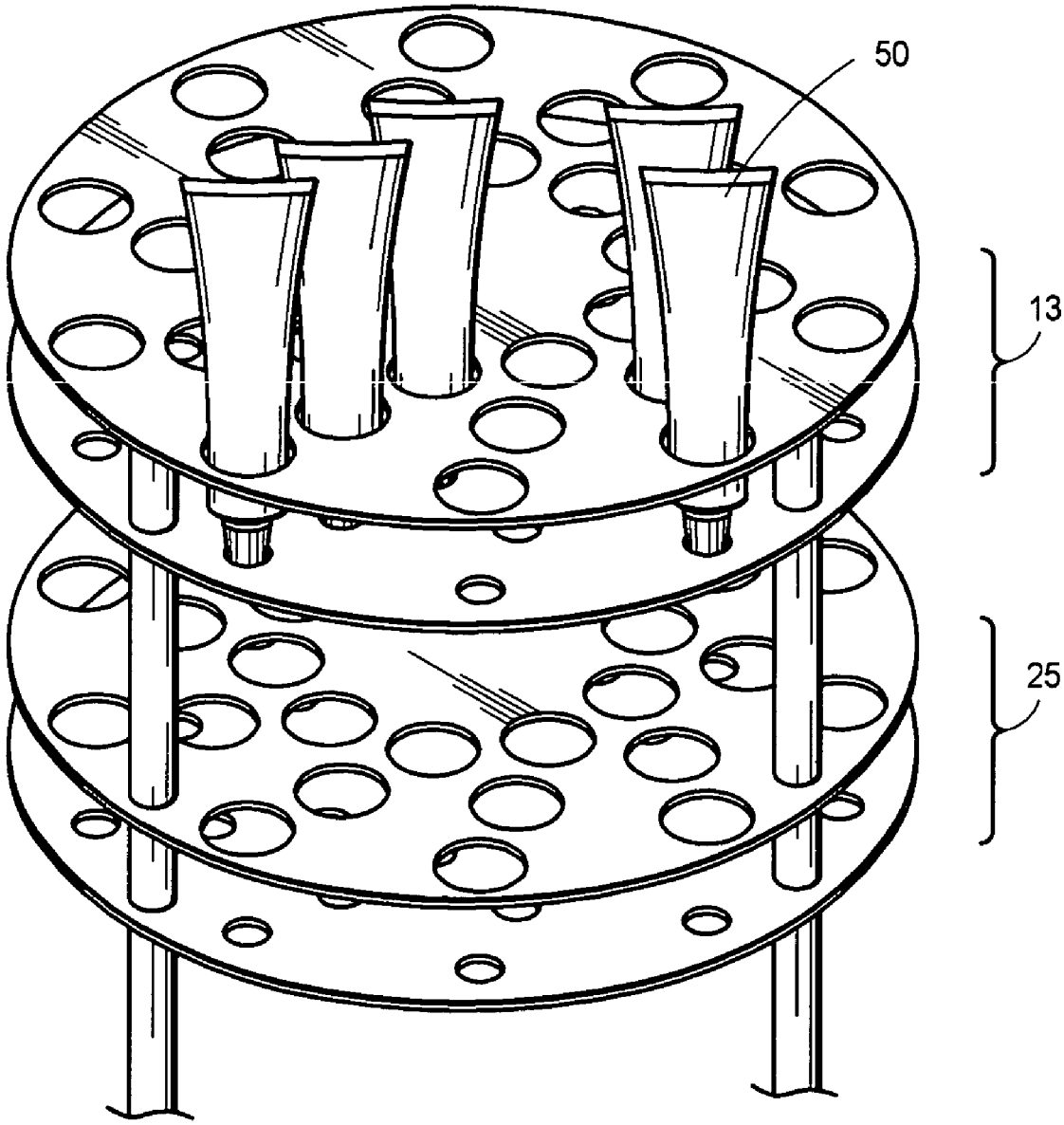
FIG. 4 is a perspective view drawing of the upper portion of the preferred embodiment of the Carousel of the present invention shown in FIG. 1, viewed from above the level of its topmost Disk, in which Consumables may be seen held in place in the topmost Pair of Disks.

FIG. 4 shows a perspective view drawing of the upper portion of the preferred embodiment of the Carousel 10 of the present invention shown in FIG. 1, viewed from above the level of its topmost Disk 11. In FIG. 4, tubes (of Consumables) 50 may be seen held in place in topmost Pair of Disks 13, as the bodies of tubes 50 are inserted into and through upper holes 16. In such position, the main bodies of tubes 50 may not move laterally, but can only move vertically up or down. Screw Tops 51 for tubes 50 may also be seen inserted into lower disk holes 17 in lower Disk 12. In such position, Screw Tops 51 are also held securely in place laterally, so long as the main bodies of tubes 50 are not smaller in diameter that the diameter of lower holes 17. When tubes 50 placed in Pair 13 in Carousel in this fashion, tubes 50 are held securely, in positions which may be readily seen and accessed by a user. Other tubes (not shown) may be inserted between Pair 13 and next lower Pair 25, and in each space between Pairs as the Carousel is expanded in a modular fashion. The entire Carousel 10 may then be rotated on Base 40 by means of rotating means 41, so that a user can view and access all tubes held in Carousel 10.

Other embodiments will be apparent to those skilled in the art from consideration of the specification and practice of the invention disclosed herein. It is intended that the specification and examples be considered as exemplary only, with a true scope of the invention being indicated by the following claims and equivalents.

What is claimed is:

1. A bottle and tube holder and display comprising:

a first disk, substantially circular in shape, having a first side and a second side, and a plurality of generally circular first holes formed therein;

the first holes are sufficiently large to accommodate the bodies of tubes of consumables;

the first holes are arranged in generally radially oriented first rows of at least two holes, each of the first rows extending from a point near the center of the first disk to a point near the perimeter of the first disk, a second disk, substantially circular in shape, having a first side and a second side, and a plurality of generally circular second holes formed therein;

the second holes are smaller in diameter than the first holes, and smaller in diameter than the body of the tubes of consumables, but sufficiently large to accommodate the smaller tops of the tubes of consumables;

the second holes are arranged in generally radially oriented second rows of at least two holes, each of the second rows extending from a point near the center of the second disk to a point near the perimeter of the second disk;

a plurality of first bars having first and second ends;

the first end of the first bars may be connected to the first disk, and the second end of the first bars may be connected to the second disk, to create a first ganged pair of disks;

a substantial number of the first holes are positioned substantially in alignment to the same number of second holes in the first ganged pair of disks when the first ends of the first bars are connected to the first disk and the second ends of the first bars are connected to the second disk;

means for rotating the first ganged pair of disks;

whereby the sides of the bodies of the tubes of consumables may be held, when placed in the first ganged pair of disks, by the first disk, at the edges of the first holes, and the sides of the tops of the tubes of consumables, when the tops are placed on the tubes of consumables, may be held, when placed in the first ganged pair of disks, by the second disk, at the edges of the second holes, and the sides of the bodies of the tubes of consumables, between and above the first and second disks of the first clanged pair of disks, may be viewed by an operator, and the ends of the bodies of the tubes of consumables may be accessed by an operator above the first ganged pair of disks.

2. The bottle and tube holder of claim 1, in which the first holes are arranged offset from one another in each first row, to form a non-radial arrangement of first holes in each first row of first holes, and the second holes are arranged similarly offset from one another in each second row, to form a non-radial arrangement of second holes in each second row of second holes.

3. The bottle and tube holder of claim 1, further comprising:

a third disk, substantially circular in shape, having a first side and a second side, and a plurality of generally circular third holes formed therein;

the third holes are sufficiently large to accommodate the bodies of tubes of consumables;

the third holes are arranged in generally radially oriented third rows of at least two holes, each of the third rows extending from a point near the center of the third disk to a point near the perimeter of the third disk;

a fourth disk, substantially circular in shape, having a first side and a second side, and a plurality of generally circular fourth holes formed therein;

the fourth holes are smaller in diameter than the third holes, and smaller in diameter than the bodies of the tubes of consumables, but sufficiently large to accommodate the smaller tops of the tubes of consumables;

the fourth holes are arranged in generally radially oriented fourth rows of at least two holes, each of the fourth rows extending from a point near the center of the fourth disk to a point near the perimeter of the fourth disk;

a plurality of second bars having first and second ends;

the first end of the second bars may be connected to the third disk, and the second end of the second bars may be connected to the fourth disk, to create a second ganged pair of disks;

a substantial number of the third holes are positioned substantially in alignment to the same number of fourth holes in the second ganged pair of disks when the first ends of the second bars are connected to the third disk and the second ends of the second bars are connected to the fourth disk;

a plurality of legs having first and second ends;

the first ends of the legs may be connected to the first disk, and the second end of the legs may be connected to the fourth disk, to thereby affix the second ganged pair of disks to the first ganged pair of disks in a rigid array;

whereby the sides of the bodies of some of the tubes of consumables may be held, when placed in the second ganged pair of disks, by the third disk at the edges of the third holes, and the sides of the tops of the some of the tubes of consumables, when the tops are placed on the some of the tubes of consumables, may be held, when placed in the second ganged pair of disks, by the fourth disk at the edges of the fourth holes, and the sides of the bodies of other tubes of consumables, between and above the first and second disks of the first ganged pair of disks, may be viewed by an operator, and the ends of the bodies of the other of the tubes may be viewed and accessed by an operator above the first ganged pairs of disks.

4. The bottle and tube holder of claim 3, in which the first holes are arranged offset from one another in each first row, to form a non-radial arrangement of first holes in each first row of first holes, the second holes are arranged offset from one another in each second row, to form a non-radial arrangement of second holes in each second row of second holes, similar to the non-radial arrangement of the first rows of first holes, the third holes are arranged offset from one another in each third row, to form a non-radial arrangement of third holes in each third row of third holes, and the fourth holes are arranged offset from one another in each fourth row, to form a non-radial arrangement of fourth holes in each fourth row of fourth holes, similar to the non-radial arrangment of the third rows of third holes.

* * * * *